United States Patent [19]

Ikeuchi et al.

[11] Patent Number: 4,883,734

[45] Date of Patent: Nov. 28, 1989

[54] TONER FOR DEVELOPMENT OF ELECTROSTATIC IMAGE AND METHOD OF FIXING EMPLOYING THE SAME

[75] Inventors: Satoru Ikeuchi; Mitutaka Arai; Yuki Okuyama, all of Hachioji; Hideki Yuri, Ibaraki; Tomoo Shiohara; Yasuhiko Oyama, both of Kyoto, all of Japan

[73] Assignees: Konica Corporation; Sekisui Kagaku Kogyo Kabushiki, both of Japan

[21] Appl. No.: 162,801

[22] Filed: Mar. 1, 1988

[30] Foreign Application Priority Data

Mar. 3, 1987 [JP] Japan ..... 62-48522

[51] Int. Cl.[4] ..... G03G 9/08; G03G 9/14

[52] U.S. Cl. ..... 430/109; 430/110; 525/248; 525/249; 525/534

[58] Field of Search ..... 430/109, 110

[56] References Cited

U.S. PATENT DOCUMENTS

| | | | |
|---|---|---|---|
| 4,246,332 | 1/1981 | Tanaka et al. | 430/109 |
| 4,367,275 | 1/1983 | Aoki et al. | 430/110 X |
| 4,600,676 | 7/1986 | Terada et al. | 430/110 X |

FOREIGN PATENT DOCUMENTS

| | | | |
|---|---|---|---|
| 60-4946 | 1/1985 | Japan | 430/109 |
| 60-262169 | 12/1985 | Japan | 430/109 |
| 61-153661 | 7/1986 | Japan | 430/109 |

*Primary Examiner*—Roland E. Martin

*Attorney, Agent, or Firm*—Jordan B. Bierman

[57] ABSTRACT

Disclosed are a toner for development of electrostatic image, comprising as the main component a resin obtained by allowing a polymer containing a polymer component with low molecular weight and a polymer component with high molecular weight, at least the polymer component with low molecular weight containing a carboxylic acid component, to react with a polyvalent metal compound, and a method of fixing a toner image employing the toner described above.

According to the present invention, there can be provided a toner for development of electrostatic image which has more improved fixability without lowering the anti-off-set property already improved, and also which can be prepared with good reproducibility without causing gelation to occur although the metal compound may be formulated therein, and can be improved in fixability without making charging characteristics unstable and at the same time without bringing about lowering in anti-off-set property, and thus an excellent toner image can be fixed.

14 Claims, 1 Drawing Sheet

TONER FOR DEVELOPMENT OF ELECTROSTATIC IMAGE AND METHOD OF FIXING EMPLOYING THE SAME

BACKGROUND OF THE INVENTION

This invention relates to a toner for development of electrostatic image to be used in electrophotography, etc., more particularly, a toner for development of electrostatic image improved in fixability without lowering the improved off-set performance, and a method of fixing a toner image employing the same.

Generally speaking, in the dry developing system, a powdery toner for development of electrostatic image charged is attached through electrical attraction onto an electrostatic latent image on a photosensitive member, then transferred onto a paper and fixed by hot rolls, etc.

Accordingly, such toner for development of electrostatic image is demanded to have various properties such as anti-blocking property (toner particles should not be agglomerated), anti-off-set property (toner should not be attached onto hot rolls, etc.) and fixability (toner should be firmly attached to paper). Particularly, recently, the toner for development of electrostatic image has been demanded to have good fixability at lower temperatures.

In the prior art, for improvement of anti-off-set property, it has been proposed that the binder in the toner for development of electrostatic image is constituted of a resin comprising a polymer component with low molecular weight and a polymer component with high molecular weight (see Japanese Unexamined Patent Publications Nos. 158340/1981, 16144/1981 and 202455/1983).

However, although an improvement of anti-off-set property can be surely accomplished by introducing a polymer component with high molecular weight into the toner for development of electrostatic image, if the glass transition point or softening point of the low molecular weight polymer component is lowered in order to realize good fixability at lower temperature without causing lowering of the improved anti-off-set property, anti-blocking property will be lowered.

On the other hand, if the proportion of the polymer component with low molecular weight is increased by decreasing the proportion of the polymer component with high molecular weight in order to realize fixability at lower temperature, anti-off-set property will be worsened.

On the other hand, there is also a proposal, in which the binder is constituted of, for example, a styrene-acrylic acid type polymer, and its molecular weight distribution is made broader without particularly incorporating a polymer component with high molecular weight as described above in this polymer, and moreover, by forming ion bonding of the carboxylic group in the polymer with metal atoms by the reaction with a metal compound to form a crosslinked structure through metal atoms, thus consequently realizing improvement of anti-off-set property by effecting formation of substantially high polymer through the crosslinked structure, although having no special polymer component with high molecular weight (see Japanese Unexamined Patent Publications Nos. 110155/1986 and 110156/1986).

However, such toner for development of electrostatic image contains a large amount of a metal compound formulated therein, and therefore the metal compound formulated may exhibit a catalytic action depending on the condition, whereby the resin in the toner for development of electrostatic image may be readily gelled, and therefore there are problems such that it is difficult to determine preparation conditions for obtaining a desired toner for development of electrostatic image by formulation of a metal compound, or that even the preparation conditions can be determined, reproducibility is bad, etc.

SUMMARY OF THE INVENTION

An object of the present invention is to cancel the above problems and provide a toner for development of electrostatic image having more improved fixability without lowering the anti-off-set property already improved by use of a special resin obtained by the reaction of a polymer comprising a polymer component with low molecular weight and a polymer component with high molecular weight with a polyvalent metal compound.

Another object of the present invention is to provide a toner for development of electrostatic image which can be prepared with good reproducibility without causing gelation to occur although the metal compound may be formulated therein, and can be improved in fixability without making charging characteristics unstable and at the same time without bringing about lowering in anti-off-set property.

The gist of the present invention for accomplishing the above objects is a toner for development of electrostatic image, comprising as the main component a resin obtained by allowing a polymer containing a polymer component with low molecular weight and a polymer component with high molecular weight, at least said polymer component with low molecular weight containing carboxylic acid component, to react with a polyvalent metal compound, and a method of fixing a toner image employing the same.

DETAILED DESCRIPTION OF THE INVENTION

Figure 1:
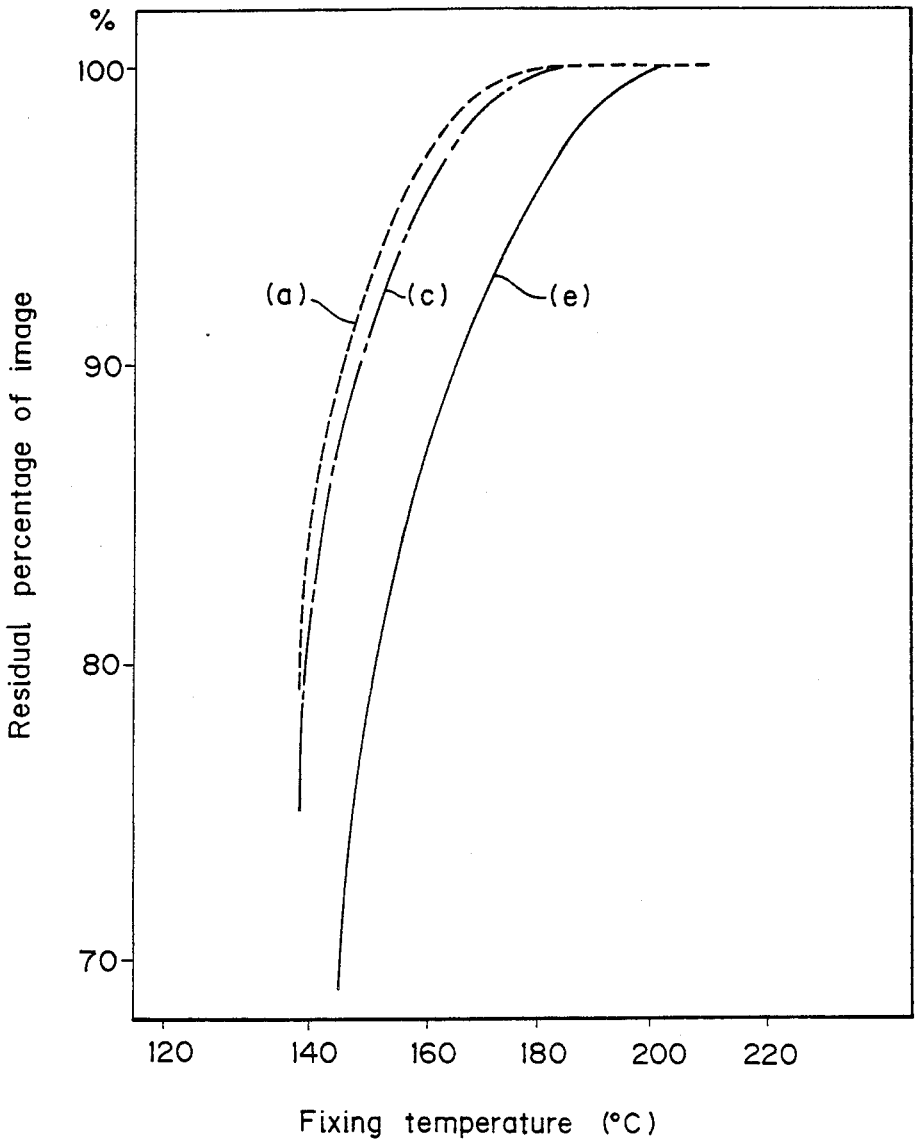
FIG. 1 is a graph showing the relationship between the residual image percentage and the fixing temperature as the result of fixability test.

The above polymer in the present invention is not particularly limited so long as it is generally used as the resin for toner, provided that in its molecular weight distribution curve, two modes are formed due to existance of the polymer component of low molecular weight and the polymer component of high molecular weight and also at least the polymer component with low molecular weight contains a carboxylic acid component. Examples of the above polymer may include those in which the polymer component with low molecular weight is an acrylic polymer or a styrene-acrylic polymer and the polymer component with high molecular weight is a styrene polymer, those in which both of the polymer component with low molecular weight and the polymer component with high molecular weight are acrylic polymers or styrene-acrylic polymers. Among them, particularly preferred are those in which both of the polymer component with low molecular weight and the polymer component with high molecular weight are styrene-acrylic polymers.

Preferable such styrene-acrylic polymers are, for example, those obtained from a styrene type monmer (a), an acrylic acid ester or methacrylic acid ester type monomer (b) and a half ester compound (c) obtained by subjecting an acrylic acid or methacrylic acid type derivative having a hydroxyl group to esterification reaction with a dicarboxylic acid, or those obtained from a styrene type component (d), a first acrylic acid type component (e) and a second acrylic acid type component (f).

Examples of the above styrene type monomer (a) may include styrene, o-methylstyrene, m-methylstyrene, p-methylstyrene, α-methylstyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and the like.

Among them, styrene, α-methylstyrene and p-methylstyrene are preferred.

Examples of the above acrylic acid ester or methacrylic acid ester type monomer (b) may include alkyl esters of acrylic acid or methacrylic acid such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, 2-chloroethyl acrylate, phenyl acrylate, methyl a-chloroacrylate, phenyl methacrylate, dimethylaminoethyl methacrylate, diethylaminoethyl methacrylate and the like. Among them, alkyl esters of acrylic acid or methacrylic acid such as ethyl acrylate, propyl acrylate, n-butyl acrylate, 2-ethylhexyl acrylate, methyl methacrylate, ethyl methacrylate, propyl methacrylate, n-butyl methacrylate, etc. may be preferably used, particularly preferably n-butyl acrylate, 2-ethylhexyl acrylate, methyl methacrylate, n-butyl methacrylate, etc.

The above half ester compound (c) can be obtained by subjecting an aliphatic dicarboxylic acid such as malonic acid, succinic acid, glutaric acid, etc. or an aromatic dicarboxylic acid such as phthalic acid, etc. to esterification reaction with a derivative of acrylic acid or methacrylic acid having a hydroxyl group.

The above dicarboxylic acid may have its hydrogen atom substituted with a halogen atom, a lower alkyl group, an alkoxy group, etc.

The above half ester compound (c) can be represented by the following formula (1):

$$CH_2{=}\overset{\overset{R_1}{|}}{C}-\overset{\overset{O}{\|}}{C}-O-L-COOH \qquad (1)$$

wherein L represents a divalent bonding group having 3 or more carbon atoms and an ester linkage in the molecular chain, and $R_1$ represents hydrogen atom or methyl group.

In the above formula, L can be further represented by the following formulae (2)–(5):

$$-(\overset{\overset{R_2}{|}}{C}H_2CHO)_m-\overset{\overset{O}{\|}}{C}-(CH_2)_n- \qquad (2)$$

wherein $R_2$ represents hydrogen atom or methyl group, m is 1 to 14 and is n 0 to 8,

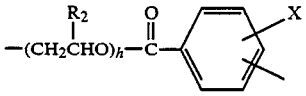

(3)

wherein $R_2$ represents the same meaning as defined above, h is an integer of 1 to 14, X is a hydrogen atom, a halogen atom, a lower alkyl group, an alkoxy group, $$-(CH_2)_j-O-\underset{\underset{O}{\|}}{C}-(CH_2)_k- \qquad (4)$$

wherein j represents an integer of 3 to 6 and k is an integer of 0 to 8,

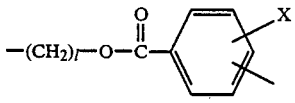

(5)

wherein e represents an integer of 3 to 6 and X is the same meaning as defined above.

Of the half ester compounds represented by the above formulae (2)–(5), those represented by the formula (2) are preferred.

Examples of the half ester compound represented by the above formula (2) to (5) may include mono(meth)acryloyloxyethyl succinate, mono(meth)acryloyloxypropyl succinate, mono(meth)acryloyloxyethyl glutarate, mono(meth)acryloyloxyethyl phthalate, mono(meth)acryloyloxypropyl phthalate and the like.

The polymer obtained from the above styrene type monomer (a), the acrylic acid or methacrylic acid ester type monomer (b) and the half ester compound (c) obtained by subjecting an acrylic acid or methacrylic acid type derivative having a hydroxyl group to esterification reaction with a dicarboxylic acid may desirably contain the monomeric units at proportions of 30 to 95% by weight, preferably 40 to 95% by weight for the above styrene monomer (a), 4.5 to 40% by weight, preferably 10 to 40% by weight for the acrylic acid or methacrylic acid ester type monomer (b) and 0.5 to 30% by weight, preferably 1 to 20% by weight for the above half ester compound (c).

If the content of the above styrene type monomer (a) is smaller than 30% by weight, pulverizability of the toner for development of electrostatic image may be worsened. If the content of the above acrylic acid or methacrylic acid ester type monomer (b) is less than 4.5% by weight, fixability may be worsened, or when the content of the above half ester compound (c) is smaller than 0.5% by weight, anti-off-set property at high temperature fixing may be worsened, and also anti-blocking property and plasticizer resistance may be sometimes lowered.

As for the multi-component type copolymer constituted of the styrene type component (d), the first acrylic acid type component (e) and the second acrylic acid type component (f), those disclosed in Japanese Unexamined Patent Publication No. 158340/1981 can be preferably used.

Irrespectively of which polymer may be employed, it is desirable in the present invention that the maximum value of the molecular weight distribution of the polymer component of the low molecular weight should be at $1\times10^3$ to $2\times10^4$, particularly $2\times10^3$ to $1\times10^4$, and the maximum value of the molecular weight distribution of the polymer component with high molecular weight at $10^5$ to $2\times10^6$, particularly $2\times10^5$ to $1\times10^6$.

If the molecular weight of the polymer component with low molecular weight is smaller than the above range, anti-blocking property may be worsened, while if it is greater than the above range, fixability may be lowered. On the other hand, if the molecular weight of the above polymer component with high molecular weight is smaller than the above range, anti-off-set property may be worsened, while if it is greater than the above range, fixability may be worsened.

Further, from the standpoint of the molecular weight distribution, as the molecular weight distribution of the polymer comprising a polymer component with low molecular weight and a polymer component with high molecular weight, a value of Mw/Mn should be desirably 3.5 or higher, preferably 4.0 to 40.

The above polymer formed with a bimodal molecular weight distribution of the low molecular weight portion and the high molecular weight portion, it is further preferred that the content of the polymer component with high molecular weight should be 15% by weight or more, particularly 20 to 35% by weight based on the whole polymer. If the content of the polymer component with high molecular weight is less than 15% by weight, there may be sometimes caused lowering in anti-off-set property.

The polymer in the present invention can be prepared according to any preparation method, provided that it has a bimodal molecular weight distribution as described above. For example, the first stage of polymerization for forming first either one of the polymer component of the polymer component with high molecular weight or the polymer component with low molecular weight is conducted, and then one of the polymer component thus formed is dissolved in the monomer which gives the polymer constituting the other polymer component to carry out the second stage of polymerization, whereby the other polymer component can be formed to provide consequently a polymer having a bimodal molecular weight distribution. The polymer thus obtained by the 2-step polymerization may be estimated to comprise the polymer component with low molecular weight and the polymer component with high molecular weight which are mixed homogeneously at molecular level.

The 2-step polymerization can be carried out by, for example, solution polymerization, suspension polymerization, emulsion polymerization, etc., but among them, solution polymerization is preferred.

On the other hand, although a polymer with a bimodal molecular weight distribution can be also obtained by mixing a polymer component with low molecular weight and a polymer component with high molecular weight, a polymer with bimodal distribution obtained by mixing may sometimes fail to be homogeneously mixed at molecular level, and therefore the polymer in the present invention should be particularly preferably one obtained by the above 2-step polymerization method.

Further, the polymer in the present invention should preferably be one with the polymer component with low molecular weight having a glass transition point of 50° C. or higher, preferably 55° C. or higher, and with the polymer component with high molecular weight having a glass transition point of 65° C. or lower, preferably 60° C. or lower. This is because improvement of anti-blocking property can be accomplished by control of the glass transition point. The glass transition point can be easily controlled by selecting appropriately the kind of the monomers.

Further, the above polymer in the present invention may contain monomeric units such as vinyl acetate, vinyl propionate, vinyl chloride, ethylene, etc. in its molecular chain, or the polymer of the above monomers blended therein, within the range which will not interfere with the object of the present invention. Also, polyester resins or epoxy resins may be contained.

The toner for development of electrostatic image according to the present invention contains as the main component the resin obtained by allowing the above polymer to react with a polyvalent metal compound. As the metal of the above polyvalent metal, there may be included Cu, Ag, Be, Mg, Ca, Sr, Ba, Zn, Cd, Al, Ti, Ge, Sn, V, Cr, Mo, Mn, Fe, Co, Ni, etc.

Of these various metals, alkaline earth metals and zinc group metals are preferred, particularly Zn and Mg. Examples of such polyvalent metal compound may include fluorides, chlorides, hydrochlorides, bromides, iodides, oxides, hydroxides, sulfides, sulfites, sulfates, selenides, tellurides, nitrides, nitrates, phosphides, phosphinates, phosphates, carbonates, orthosilicates, acetates, oxalates, lower alkyl metal compounds such as methylated and ethylated products of various metals as mentioned above.

Among them, acetates and oxides are preferred.

The amount of the polyvalent metal compound may differ depending on the kind and the amount of the monomer constituting the polymer and cannot be defined wholly. For example, when the polymer is constituted of a polymer component with low molecular weight and a polymer component with high molecular weight consisting of the above styrene type monomer (a), the above (meth)acrylic acid ester type monomer (b) and the above half ester compound (c), 0.1 to 1 mole of the polyvalent metal compound per 1 mole of the half ester compound (c) charged may be sufficient.

For allowing the polyvalent metal compound to react with the above polymer, the above metal compound or a solution containing the metal compound dispersed therein may be mixed into a solution containing the above polymer obtained by the 2-step polymerization according to solution polymerization, the temperature of the mixture is elevated over about 1 to 3 hours to effect desolventization, and the mixture is maintained under the state where the temperature has reached about 150° to 180° C. for 1 hour or longer, thereby completing the reaction. In some cases, the metal compound may be also permitted to exist together with the solvent before initiation of the above 2-step polymerization, or alternatively the above polymer obtained by desolventization and the above metal compound may be melted and kneaded by use of roll mills, kneader, extruder, etc.

The resin obtained by the reaction between the above polymer and the polyvalent metal compound thus obtained has the carboxylic acid component contained in the polymer component with low molecular weight and metal atoms which are ion bonded to the carboxylic acid component.

Accordingly, since a carboxlic acid component is contained in the polymer component with low molecular weight, even if the content of the polymer component with low molecular weight in the polymer may be increased, anti-off-set property will not be worsened on behalf of crosslinking by ion bonding through a metal, and yet the property of the polymer component with low molecular weight can be maintained, whereby also fixability can be improved.

The toner for development of electrostatic image according to the present invention contains the resin crosslinked through metal atoms as described above as the main component. Accordingly, in the toner for development of electrostatic image, other resins, pigments or dyes may be added for the purpose of, for example, improving stability of triboelectric charging characteristics and pulverizability within the range which does not interfere with the object of the present invention.

Examples of other resins may include rosin-modified phenol formalin resin, epoxy resin, polyurethane resin, cellulose resin, polyether resin, polyester resin, styrene-butadiene resin, etc.

As the above pigment or dye, there may be included Carbon Black, Nigrosine dye, Aniline Blue, Chalconile Blue, Chrome Yellow, Ultramarine Blue, Du Pont Oil Red, Orient Oil Red, Quinoline Yellow, Methylene Blue Chloride, Phthalocyanine Blue, Malachite Green Oxalate, Lamp Black, Rose Bengal, etc.

According to the present invention, since the main component comprises a resin crosslinked through metal atoms obtained by the reaction between a polymer comprising a polymer component with low molecular weight and a polymer component with high molecular weight, at least said low molecular weight polymer component containing a carboxylic acid component, and a polyvalent metal compound, it is possible to provide a toner for development of electrostatic image which can realize good fixability at low temperature by increasing the content of the polymer component with low molecular weight and yet can prevent lowering in anti-off-set property by mild cross-linked bonding of the polymer with low molecular weight through metals.

Besides, in the present invention, since a polymer with a bimodal molecular weight distribution is used, the polymer component with high molecular weight also contributes to anti-off-set property, and therefore the amount of the polyvalent metal compound reacted with the polymer can be also decreased. Accordingly, a toner for development of electrostatic image with stable charging characteristics can be provided.

Also, the toner for development of electrostatic image is smaller in the amount of the polyvalent metal compound formulated, whereby there occurs no gelation and the toner can be produced with good reproducibility. Thus, the toner for development of electrostatic image can be prepared under stable preparation condition.

EXAMPLE

Preparation example 1

A 2-liter separable flask was charged with 400 ml of toluene and the air in the flask was replaced by nitrogen.

Then, toluene in the flask was heated under reflux.

Subsequently, into the flask were charged 192 g of styrene, 48 g of n-butyl acrylate and 0.5 g of benzoyl peroxide, and polymerization reaction of the first stage was conducted under reflux over 12 hours to prepare a polymer component with high molecular weight.

After elapse of 12 hours, into the above flask was added dropwise over 2 hours a mixture of 164 g of styrene, 56 g of n-butyl acrylate, 80 g of monoacryloyloxyethyl succinate and 8 g of benzoyl peroxide to carry out the polymerization reaction of the second stage.

After completion of the dropwise addition of the above mixture, the polymerization reaction of the second stage was continued at the reflux temperature for additional one hour to prepare a polymer component with low molecular weight. Then, 8 g of zinc oxide was added into the above flask and the mixture was stirred for 1 hour.

Then, toluene which is the solvent was evaporated under reduced pressure to give a resin (1) which is the reaction product between a polymer having side chains containing a carboxylic group and zinc oxide.

The molecular weight distribution of this resin (1) was measured by HLC-802UR (column: HG type of TSK-GEL, produced by Toyosoda K.K.), and consequently the resin (1) was found to have maximum values at $4.0 \times 10^5$ and $7 \times 10^3$, thus exhibiting a bimodal molecular weight distribution.

Preparation example 2

A resin (2) was prepared in the same manner as in the above Preparation example 1, except for:

preparing a polymer component with high molecular weight by use of 100 g of styrene, 40 of n-butyl acrylate and 60 g of n-butyl methacrylate in place of 192 g of styrene and 48 g n-butyl acrylate, preparing a polymer component with low molecular weight by us of 400 g of styrene, 192 g of n-butyl methacrylate, 160 g of methyl methacrylate and 48 g of monoacryloyloxyethyl isophthalate in place of 164 g of styrene, 56 g of n-butyl acrylate and 80 g of monoacryloyloxyethyl succinate, and using 22.4 g of zinc acetate in place of 8 g of zinc oxide.

This resin (2) was examined for its molecular weight distribution similarly as described in the above Preparation example 1 to find that it had maximum values at $3.0 \times 10^5$ and $8.6 \times 10^3$.

Preparation example 3

A resin (3) was prepared in the same manner as in the above Preparation example 1 except for:

preparing a polymer component with high molecular weight by using 133 g of styrene, 20 g of 2-ethylhexyl acrylate, 8 g of monoacryloyloxylethyl succinate and 0.6 g of azobisisobutyronitrile in place of 192 g of styrene, 48 g of n-butyl acrylate and 0.5 g of benzoyl peroxide, preparing a polymer component with low molecular weight by using 664 g of styrene, 56 g of 2-ethylhexyl acrylate, 80 g of monoacryloyloxyethyl succinate and 10 g of azobisisobutyronitrile in place of 164 g of styrene, 56 g of n-butyl acrylate, 80 g of monoacryloyloxyethyl succinate and 8 g of benzoyl peroxide, and using 12.8 g of magnesium oxide in place of 8 g of zinc oxide.

This resin (3) was examined for its molecular weight distribution similarly as described in the above Preparation example 1 to find that it had maximum values at $5.5 \times 10^5$ and $6.0 \times 10^3$.

Preparation example 4

A resin (4) was prepared in the same manner as in the above Preparation example 1 except for:

preparing a polymer component with high molecular weight by using 180 g of styrene, 48 g of n-butyl acrylate and 12 g of methyl methacrylate in place of 192 g of styrene and 48 g of n-butyl acrylate, preparing a polymer component with low molecular weight by using 600 g of styrene, 56 g of n-butyl methacrylate, 120 g of methyl methacrylate and 24 g of monoacryloyloxyethyl succinate in place of 164 g of styrene, 56 g of n-butyl acrylate and 80 g of monoacryloyloxyethyl succinate, and using 2.4 g of zinc oxide in place of 8 g of zinc oxide.

This resin (4) was examined for its molecular weight distribution similarly as described in the above Preparation example 1 to find that it had maximum values at $2.0\times10^5$ and $3.2\times10^3$.

Comparative preparation example 1

A resin (5) was prepared in the same manner as in the above Preparation example 1 except for:

preparing a polymer component with low molecular weight by using 680 g of styrene and 120 g of n-butyl methacrylate in place of 164 of styrene, 56 g of n-butyl acrylate and 80 g of monoacryloyloxyethyl succinate, and not using 8 g of zinc oxide.

When this resin (5) was examined for its molecular weight distribution similarly as described in the above Preparation example 1, it was found to have maximum values at $2.8\times10^5$ and $5.3\times10^3$.

Comparative preparation example 2

A 2-liter separable flask was charged with 400 ml of toluene, and the air in the flask was replaced with nitrogen.

Then, toluene in the flask was heated under reflux.

Subsequently, solution polymerization was carried out, while adding dropwise into the flask a mixture comprising 750 g of styrene, 200 g of n-butyl acrylate, 50 g of monoacryloyloxyethyl succinate and 1 g of benzoyl peroxide over 2.5 hours.

After completion of the dropwise addition of the above mixture, the polymerization reaction was continued at the reflux temperature for additional 1 hour.

Then, 18 g of zinc oxide was added into the above flask.

Then, toluene which is the solvent was evaporated under reduced pressure to give a resin (6) which is the reaction product between a polymer having side chains containing a carboxylic group and zinc oxide.

When the molecular weight distribution of this resin (6) was measured similarly as in the above Preparation example 1, this resin (6) was found to have a maximum value at $2\times10^4$, thus exhibiting a single mode of molecular distribution.

In preparation of the resin (6), gelation of the polymer frequently occurred, whereby the resin (6) could not be obtained stably, with reproducibility being poor.

Examples 1–4, Comparative examples 1–2

As shown in Table 1, 100 parts each of the resins (1)–(6) obtained in the above Preparation examples 1–4 Comparative preparation examples 1, 2 and 10 parts of carbon black (tradename "MOGAL L", produced by Cabot Co.) were kneaded and coarsely pulverized after cooling, followed further by micropulverization by means of a jet mill to give six kinds of toners for development of electrostatic image (a)–(f) having average particle size of about 11.0 μm. These developers all exhibited good triboelectric charging quantities.

Six kinds of developers were obtained by mixing 4 parts each of the respective toners (a)–(f) for development of electrostatic image and 96 parts of iron powder carrier with an average particle size of about 50–80 μm.

Each of these developers was mounted in an electrophotographic copying machine (U-Bix 1800, produced by Konishiroku Photo Industry K.K.), and presence of generation of off-set was tested by varying the setting temperature of the fixing roller as shown in Table 1. More specifically, presence of generation of off-set was evaluated by whether the image was transferred onto the fixing roller and the off-set image was retransferred onto the paper after the second rotation of the roller et seq, when an unfixed image was passed through hot roll fixer. The results are shown in Table 1.

TABLE 1

| | Kinds of resin | Kinds of toner | Temperature of fixing roller (°C.) | | | | | | | | |
|---|---|---|---|---|---|---|---|---|---|---|---|
| | | | 140 | 150 | 160 | 180 | 190 | 200 | 210 | 220 | 230 |
| Example 1 | resin (1) | toner (a) | x | o | o | o | o | o | o | x | x |
| Example 2 | resin (2) | toner (b) | x | o | o | o | o | o | o | x | x |
| Example 3 | resin (3) | toner (c) | x | o | o | o | o | o | o | x | x |
| Example 4 | resin (4) | toner (d) | x | o | o | o | o | o | o | x | x |
| Comparative Example 1 | resin (5) | toner (e) | x | o | o | o | o | o | o | x | x |
| Comparative Example 2 | resin (6) | toner (f) | x | o | o | o | o | x | x | x | x |

Note;
x: off-set was generated;
o: off-set was not generated

As shown in Table 1, the toners for development of electrostatic image according to the present invention were found to exhibit anti-off-set property which is equal to or better than the toners for development of electrostatic image of the prior art shown in Comparative examples.

Also, fixability of the developers by use of the toners for development of electrostatic image (a), (c) and (e) was evaluated by varying the temperature of the fixing roller.

More specifically, the images fixed by the fixing roller under various setting temperatures were rubbed under a certain load by means of rubbing tesing machine, and the residual percentage of the image was measured by a microdensitometer. The results are shown in FIG. 1.

As shown in FIG. 1, the toners for development of electrostatic image according to the present invention exhibit higher image residual percentage as compared with the toners for development of electrostatic image of the prior art shown in Comparative examples, whereby the temperature range with good fixability and with little disturbance of image could be lowered to about 140° C. And, the toner for development of electrostatic image obtained by use of the toner for development of electro-static image according to the present invention could accomplish improvement of fixability of 10-fold or more at the temperature range of 140° to 160° C. (low temperature range), as compared with the toner for development of electrostatic image (e) by use of the resin (5) which has a bimodal molecular weight distribution but has not been reacted with a metal compound.

As a consequence, the toner for development of electrostatic image by use of a resin obtained by the reaction of a polymer having a single mode of molecular weight distribution with a metal compound, even if improved in fixability, has poor anti-off-set property, while in the toner for development of electrostatic image by use of a resin having a bimodal molecular weight distribution for improvement of anti-off-set property, fixability is worsened. In the present invention, since the toner for development of electrostatic image by use of a resin obtained by allowing a resin having a bimodal molecular weight distribution to reaction with a small amount of polyvalent metal compound can accomplish improvement of fixability without lowering the improved anti-off-set property, whereby the fixing temperature width could be lowered from around 160° C. of the prior art to about 140° C.

We claim:

1. A toner for developing an electrostatic image comprising, as a main component, a resin obtained by allowing a polymer containing a low molecular weight polymer component and a high molecular weight polymer component, wherein at least said lower molecular weight polymer component contains a carboxylic acid component; to react with a polyvalent metal compound, said low molecular weight polymer component being obtained from (a) a styrene monomer, (b) an acrylic acid ester or methacrylic acid ester type monomer, and (c) a half ester compound obtained by subjecting an acrylic acid or methacrylic acid type derivative having a hydroxyl group to an esterification reaction with a dicarboxylic acid, said low molecular weight polymer component having a maximum molecular weight distribution of $1\times10^3$ to $2\times10^4$, said polymer component of high molecular weight having a maximum molecular weight distribution of $10^5$ to $2\times10^6$.

2. The toner for development of electrostatic image according to claim 1, wherein both of said polymer component with low molecular weight and said polymer component with high molecular weight are obtained from a styrene type monomer (a), an acrylic acid ester or methacrylic acid ester type monomer (b), and a half ester compound (c) obtained by subjecting an acrylic acid or methacrylic acid type derivative having a hydroxyl group to esterification reaction with a dicarboxylic acid.

3. The toner for development of electrostatic image according to claim 1, wherein said half ester compound (c) is represented by the formula:

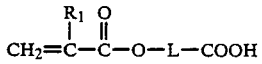

wherein L represents a divalent bonding group having 3 or more carbon atoms and an ester linkage in the molecular chain, and $R_1$ represents hydrogen atom or methyl group.

4. The toner of claim 3 wherein L is represented by the formula:

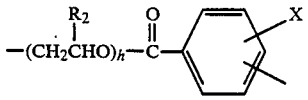

wherein $R_2$ represents hydrogen or a methyl group, h is an integer of to 14, x is hydrogen, halogen, a lower alkyl group, or an alkoxy group.

5. The toner of claim 4 wherein said metal compound is a compound of a zinc group metal or an alkaline earth metal.

6. The toner for development of electrostatic image according to claim 3, wherein L in the above formula is a divalent bonding group represented by the formula:

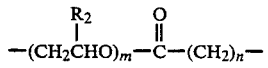

wherein $R_2$ represents hydrogen atom or methyl group, m is 1 to 14 and n is 0 to 8.

7. The toner for development of electrostatic image according to claim 1, wherein said metal compound is a compound of a zinc group metal or an alkaline earth metal.

8. The toner for development of electrostatic image according to claim 1, wherein the metal of said polyvalent metal compound is selected from the group consisting of Cu, Ag, Be, Mg, Ca, Sr, Ba, Zn, Cd, Al, Ti, Ge, Sn, V, Cr, Mo, Mn, Fe, Co and Ni.

9. The toner for development of electrostatic image according to claim 1, wherein said polymer component with low molecular weight has a maximum value of the molecular weight distribution at $1\times10^3$ to $2\times10^4$, and said polymer component with high molecular weight has a maximum value of the molecular weight distribution at $10^5$ to $2\times10^6$; said polymer component with low molecular weight is obtained from a styrene type monomer (a), an acrylic acid ester or methacrylic acid ester type monomer (b), and a half ester compound (c) represented by the formula:

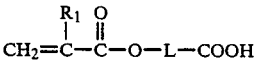

wherein $R_1$ represents hydrogen atom or methyl group and L represents a divalent bonding group represented by the formula:

$$-(CH_2\overset{R_2}{\overset{|}{C}}HO)_m-\overset{O}{\overset{\|}{C}}-(CH_2)_n-$$

(wherein $R_2$ represents hydrogen atom or methyl group, m is 1 to 14 and n is 0 to 8),
and said polyvalent metal compound is a compound of a zinc group metal or an alkaline earth metal.

10. The toner for development of electrostatic image according to claim 1, wherein said styrene type monomer (a) is styrene, o-methylstyrene or p-methylstyrene; said acrylic acid ester or methacrylic acid ester type monomer (b) is n-butyl acrylate, 2-ethylhexyl acrylate, methyl methacrylate or n-butyl methacrylate; said half ester compound (c) is monoacryloyloxyethyl succinate or monoacryloyloxyethyl phthalate; and said polyvalent metal compound is zinc oxide, magnesium oxide or zinc acetate.

11. The toner for development of electrostatic image according to claim 1, wherein said styrene type monomer (a) is styrene; said acrylic acid ester or methacrylic acid ester type monomer (b) is n-butyl acrylate; said half ester compound (c) is monoacryloyloxyethyl succinate; and said polyvalent metal compound is zinc oxide.

12. The toner for development of electrostatic image according to claim 1, wherein the content of said styrene type monomer (a) is 30 to 95% by weight, the content of said acrylic acid or methacrylic acid ester type monomer (b) is 4.5 to 40% by weight and the content of said half ester compound (c) is 0.5 to 30% by weight.

13. The toner for development of electrostatic image according to claim 1, wherein the content of said polymer component with high molecular weight is 15% by weight or more based on the whole polymer.

14. The toner for development of electrostatic image according to claim 1, wherein said polyvalent metal compound is used in an amount of 0.1 to 1 mol per mole of the half ester compound, when the polymer is constituted of a polymer component with low molecular weight and a polymer component with high molecular weight consisting of a styrene type monomer (a), a (meth)acrylic acid ester type monomer (b) and a half ester compound (c).

* * * * *